US010456633B1

(12) United States Patent
Polson

(10) Patent No.: US 10,456,633 B1
(45) Date of Patent: Oct. 29, 2019

(54) SYSTEMS AND METHODS FOR STRINGING A RACKET

(71) Applicant: Matthew James Polson, Salt Lake City, UT (US)

(72) Inventor: Matthew James Polson, Salt Lake City, UT (US)

( * ) Notice: Subject to any disclaimer, the term of this patent is extended or adjusted under 35 U.S.C. 154(b) by 0 days.

(21) Appl. No.: 16/021,836

(22) Filed: Jun. 28, 2018

(51) Int. Cl.
*A63B 51/14* (2006.01)

(52) U.S. Cl.
CPC ..... *A63B 51/14* (2013.01)

(58) Field of Classification Search
CPC ..... A63B 51/14; A63B 51/00; A63B 51/16; A63B 51/01
See application file for complete search history.

(56) References Cited

U.S. PATENT DOCUMENTS

| | | | | |
|---|---|---|---|---|
| 1,943,400 | A * | 1/1934 | Fischmann | A63B 51/14 473/556 |
| 3,635,080 | A | 1/1972 | Krueger et al. | |
| 6,402,646 | B1 * | 6/2002 | Wolf | A63B 49/00 473/543 |
| 2011/0111893 | A1 | 5/2011 | Severa et al. | |
| 2015/0133243 | A1 * | 5/2015 | Zdrazila | A63B 51/16 473/556 |
| 2017/0080298 | A1 * | 3/2017 | Yadav | A63B 24/00 |

FOREIGN PATENT DOCUMENTS

| | | | | |
|---|---|---|---|---|
| CH | 713236 | A1 * | 6/2018 | A63B 24/00 |
| CN | 200977377 | Y | 11/2007 | |
| DE | 4100755 | A1 * | 8/1991 | A63B 51/14 |
| EP | 1393781 | A1 * | 3/2004 | A63B 51/14 |
| FR | 2740046 | A1 * | 4/1997 | A63B 51/14 |
| FR | 2740046 | A1 | 4/1997 | |

OTHER PUBLICATIONS

Tanner, Markus, "Racket Stringing Machine", Tannertec—The First Full Automatic Stringing Machine (Canceled), https://www.kickstarter.com/projects/1187623175/tannertec-the-first-full-automatic-stringing-machi?ref=category_location last accessed Jun. 28, 2018, 32 pages.

* cited by examiner

*Primary Examiner* — Raleigh W Chiu
(74) *Attorney, Agent, or Firm* — Dorsey & Whitney LLP

(57) ABSTRACT

Embodiments disclosed herein relate to systems and methods for stringing a racket. In an embodiment, a system for stringing a racket includes a support structure, a mounting device, actuators, links, and a controller. Each actuator includes a selectively movable arm movable between a retracted position and an extended position. Each link is coupled to a different arm and configured to couple to a string on the racket. The controller is configured to coordinate movement of each arm between the retracted position and the extended position in a predetermined sequence. Movement of each arm in the predetermined sequence is effective to tighten the racket string on the head of racket when the racket string is woven across a head of the racket such and each link is coupled to a different portion of the racket string between two adjacent grommet holes on the head of the racket.

19 Claims, 8 Drawing Sheets

SYSTEMS AND METHODS FOR STRINGING A RACKET

BACKGROUND

Conventional systems and methods of stringing a racket require the use of two opposing clamps applied at each point a string is pulled through opposing grommet holes on the racket. The two opposing clamps are used to hold tension on a segment of the string while a different segment of the string is tensioned. The clamps are then moved to another portion of the racket for tensioning yet another segment of string. This process is repeated over and over again throughout the stringing of the racket, and requires repositioning of the clamps, multiple times.

Accordingly, users and designers of racket stringing systems continue to seek more efficient racket stringing systems.

SUMMARY

Embodiments disclosed herein relate to systems and method for stringing and tensioning a racket. In an embodiment, a system for stringing a racket includes a support structure, one or more mounting devices configured to mount the racket to the support structure, a plurality of actuators, a plurality of links, a string feed assembly, a string collection assembly, and a controller. Each actuator of the plurality of actuators includes a selectively movable arm movable between a retracted position and an extended position. Each link of the plurality of links is configured to couple to a string on the racket at a first portion of the link and coupled to a different arm of the plurality of actuators at a second portion of the link. The string feed assembly is configured to provide racket string to the racket for stringing. The string collection assembly is configured to collect string from the racket. The controller is configured to coordinate movement of each arm in the plurality of actuators from the retracted position to the extended position or from the extended position to the retracted position in a predetermined sequence. Movement of each arm in the plurality of actuators in the predetermined sequence is effective to tighten the racket string on the head of racket when (1) the racket string from the string feed assembly is woven across a head of the racket such that different portions of the racket string are positioned between different adjacent grommet holes of a plurality of grommet holes on the head of the racket, and (2) the first portion of each link of the plurality of links is coupled to a different portion of the racket string between two adjacent grommet holes of the plurality of grommet holes on the head of the racket such that when the arm moves from the extended position to the retracted position, the link pulls the portion of the racket string positioned between the adjacent grommet holes away from the adjacent grommet holes.

In an embodiment, a method of stringing a racket includes mounting the racket to a support structure. The method also includes providing racket string from a string feed assembly to a head of the racket such that different portions of the racket string are positioned between different adjacent grommet holes of a plurality of grommet holes on the head of the racket. The method also includes coupling a first portion of each link of a plurality of links to a different portion of the racket string between two adjacent grommet holes of the plurality of grommet holes on the head of the racket, a second portion of each link of the plurality of links being coupled to a different actuator of a plurality of actuators. The method also includes, with a controller and in a predetermined sequence, activating movement of an arm in each actuator of the plurality of actuators between a retracted position and an extended position such that when the arm moves from the extended position to the retracted position, the link pulls the portion of the racket string positioned between the adjacent grommet holes away from the adjacent grommet holes to tighten the racket string on the head of racket. The method also includes collecting a portion of the racket string from the head of the racket with a string collection assembly.

In an embodiment a pre-woven string template for restringing a racket is disclosed. The template includes a plurality of strings woven in a predetermined pattern of a stringed face of the racket. Multiple strings of the plurality of strings each having a first end and a second end. The first end is configured to extend through a first grommet hole of a plurality of grommet holes on a head of the racket and couple to a first end of a first adjacent string of the multiple strings extending through a first adjacent grommet hole of the plurality of grommet holes. The second end is configured to extend through a second grommet hole of the plurality of grommet holes and couple to a second end of a second adjacent string of the multiple strings extending through a second adjacent grommet hole of the plurality of grommet holes. The template also includes a first template end on one of the plurality of strings configured to couple to a racket string end of a racket string on a string feed assembly of a restringing system. The template also includes a second template end on one of the plurality of strings configured to couple to a string collection assembly of the restringing system.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments disclosed herein relate to systems and methods of stringing a racket, and to systems and methods for tensioning strings on a racket. The systems and methods described herein reduce the manual labor and time required to string and/or tension strings on a racket. Embodiments disclosed herein may be applied to all types of rackets, such as tennis rackets, racquetball rackets, badminton rackets, or other suitable rackets.

Conventional systems and methods of stringing a racket require the use of two opposing clamps applied at each point a string is pulled through opposing grommet holes on the racket. The two opposing clamps are used to hold tension on a segment of the string while a different segment of the string is tensioned. The clamps are then moved to another portion of the racket for tensioning yet another segment of string. This process is repeated over and over again throughout the stringing of the racket, and requires repositioning of the clamps, multiple times. Conventional processes of stringing a racket, then, typically require a significant amount of time and human labor.

Various embodiments of the systems and methods for stringing a racket disclosed herein reduce an amount of time and/or human labor required to string a racket. Additionally, various embodiments of the systems and methods for stringing a racket disclosed herein also improve the accuracy of tensioning and reduce potential defects of string on a racket. As shall be described in greater detail below, in many embodiments of systems and methods for stringing a racket disclosed herein, only two clamps are needed: a first clamp near a beginning or first string hole of the racket, and a second clamp near an end or last string hole of the racket. These two clamps are able to maintain tension throughout the entire stringing process without the need to continually repositioning the clamps. The rackets referenced in this disclosure may include any stringed racket, such as a tennis racket, a racquetball racket, a badminton racket, etc.

In some embodiments, a system for stringing a racket can include a support configured to support a racket during strings, a plurality of actuators, a plurality of links each coupling a different one of the actuators to a different portion of string on the racket, and a controller configured to coordinate movement of the plurality of actuators in a predetermined sequence. As the plurality of actuators move in the predetermined sequence, the string on the racket is replaced or tightened.

Figure 1:
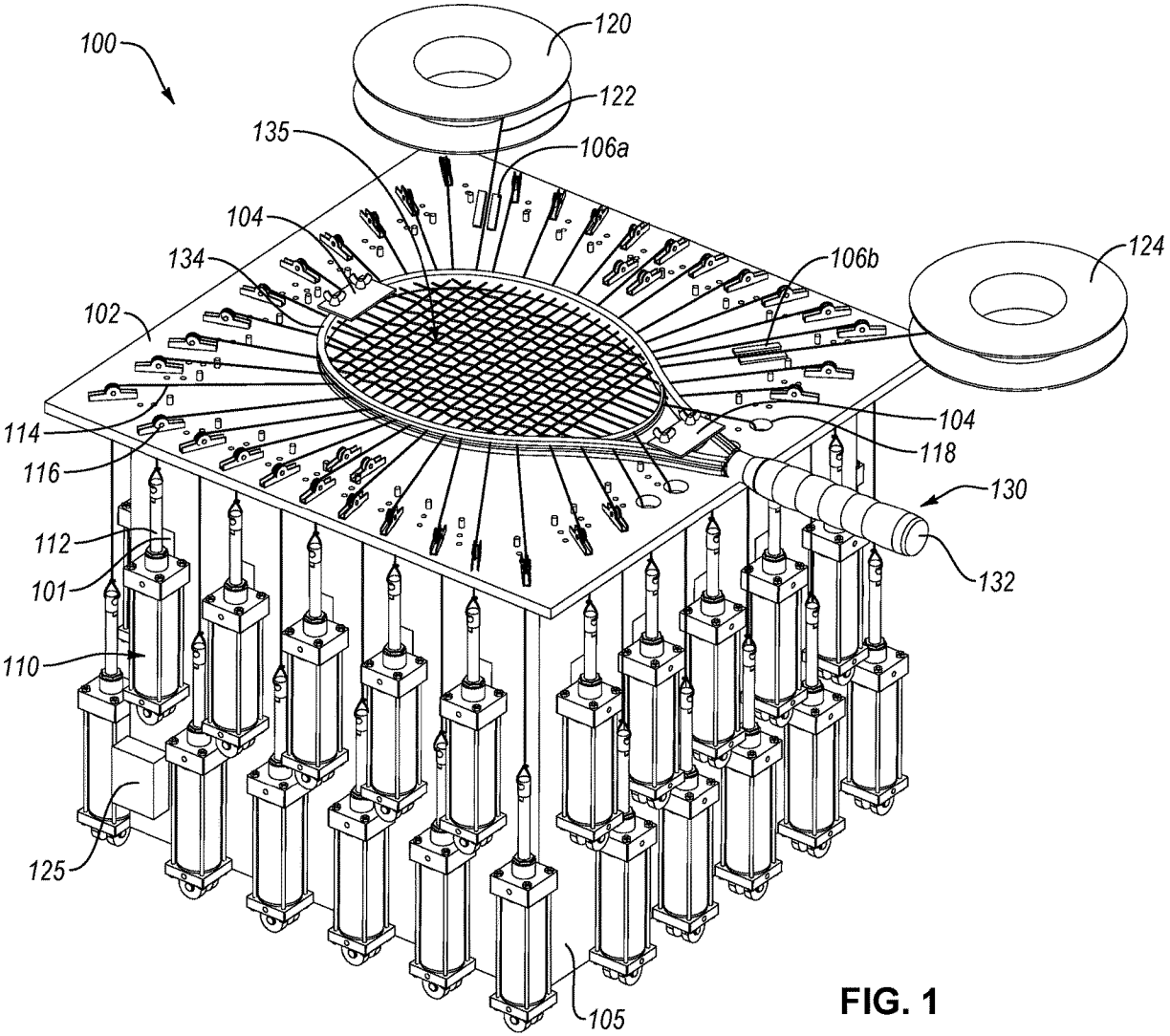
FIG. 1 is an isometric view of a system for stringing a racket, according to an embodiment.

FIG. 1 is an isometric view of a system 100 for stringing a racket 130. The system 100 includes a support structure 102, one or more mounting devices 104, a plurality of actuators 110, a plurality of links 114, a string feed assembly 120, a string collection assembly 124, and a controller 125. The support structure 102 is configured to support the racket 130 while the racket is stringed, re-stringed, or tensioned. The system 100 includes two mounting devices 104. The mounting devices 104 are positioned and configured to secure a top portion of a head 134 of the racket 130 and a bottom portion of the head 134 of the racket 130 to the support structure 102. The mounting devices 104 can each include, for example, a plate and one or more bolts and nuts. The one or more bolts and nuts can tighten the plate against the top portion or the bottom portion of the head 134 of the racket 130 to securely mount the racket 130 on the support structure 102.

The system 100 also can include, in some embodiments, a plurality of openings in the support structure 102 sized to allow links 114 coupled to the actuators 110 and the string 122 on the racket 130 to pass therethrough. The plurality of openings are positioned to correspond with a plurality of actuators 110 positioned proximate (such as below, above, or to the side of) the plurality of openings. For example, the at least a portion of each opening of the plurality of openings may be aligned with an axis of an arm 112 of a different actuator 110. In other embodiments, the actuators 110 can be positioned such that the plurality of openings on the support structure 102 are unnecessary. For example, the plurality of actuators can be positioned on a plane of the support structure 102.

Figure 2:
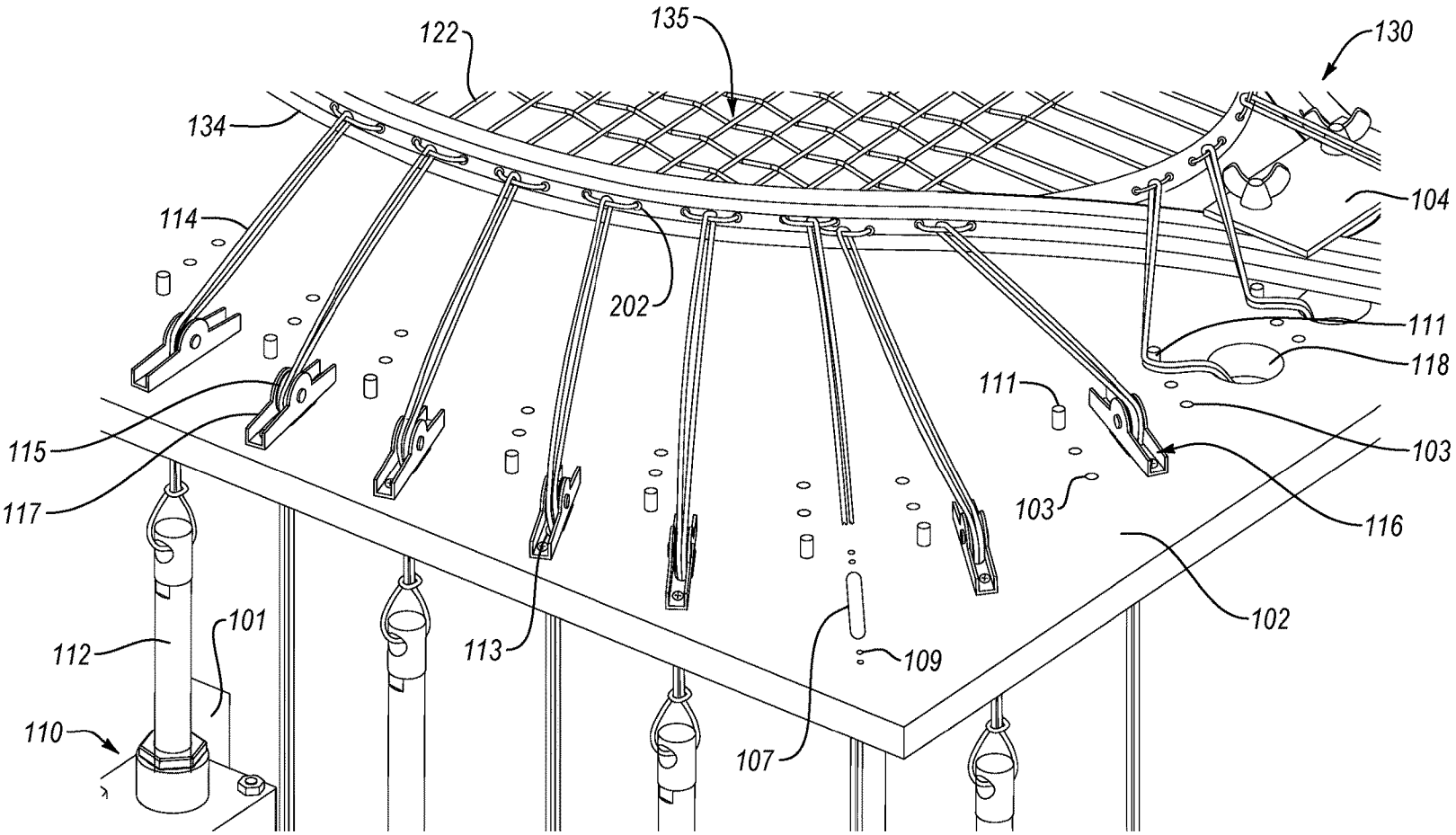
FIG. 2 is a close-up isometric view of a portion of the system for stringing a racket, according to an embodiment.

Turning to FIG. 2, the plurality of openings can include a variety of shapes or configurations. For example, the support structure 102 of system 100 includes a plurality of substantially circular openings 118 and a plurality of slot-like or elongated openings 107. While reference is made to elongated and circular openings, the one or more openings can include other shapes and configurations. Each of the plurality of elongated openings 118 can be positioned to correspond to a different pulley block 116 coupled to the support structure, while each of the substantially circular openings 118 are devoid of any corresponding pulley block 116. In some embodiments, each of the plurality of substantially circular openings 118 also can include a ring coupled to the support structure 102 and at least partially defining the substantially circular opening 118. While the support structure 102 includes both elongated openings 107 each corresponding to a different pulley block 116 and substantially circular openings 118 devoid of any corresponding pulley block, in other embodiments, the support structure 102 may be sized such that each of the one or more openings corresponds to a pulley block 116.

The support structure 102 also can include a plurality of a pulley blocks 116 coupled thereto. As noted above, each of the plurality of pulley blocks 116 can positioned on the support structure 102 to correspond to a different one of at least a portion of the plurality of openings, such as the plurality of the elongated openings 107, in the support structure 102. Each pulley block 116 includes a wheel support structure 117 and a wheel 115 coupled to the wheel support structure. The pulley block 116 can include any of a number of different pulley blocks known in the art. In the system 100 shown in FIG. 2, each of the pulley blocks 116 include a wheel support structure 117 that defines an opening 113 sized to allow a link 114 to pass therethrough to interface with the wheel 115. In other embodiments, the wheel support structure can have two opposing members configured to couple to the support structure 102 and defining a slot positioned between the two opposing members. The slot can be sized to align with the elongated opening 107, and the wheel 115 can be at least partially housed within the slot of the wheel support structure. Each pulley block 116 can be removably coupled to the support structure with one of screws, bolts, or pins.

The support structure 102 can include one or more holes 109 positioned proximate the elongated opening 107, each of the one or more holes configured to receive a screw, bolt, or pin for coupling the pulley block 116 to the support structure 106. The one or more holes 109 can be positioned at opposing ends of the elongated opening 107 or, alternatively, on opposing sides of the elongated opening 107.

In some embodiments, one or more of the pulley blocks 116 can be movably mounted or coupled to the support structure 102 to allow the system 100 to be adjusted to the size of the racket 130. For example, a pulley block 116 can be moved along a corresponding elongated opening 107 to positioned the pulley block 116 closer or further from the head 134 of the racket 130. In these and other embodiments, the support structure 102 can include a plurality of holes 109 positioned proximate the elongated opening 107, allowing the pulley block 116 to be mounted to the support structure 102 at different lengths from the head 134 of the racket 130. A plurality of holes 109 can be positioned at each opposing end of the elongated opening 107 or, alternatively, on each opposing side of the elongated opening 107.

The system 100 also can include one or more pegs 111 removably coupled to the support structure 102. The one or more pegs 111 can be utilized to adjust the system 100 to a certain size of the racket 130 mounted to the support structure. The one or more pegs 111 can be used in combination with or alternative to a pulley block 116 movably coupled to the support structure 102 to allow the system 100 to be adjusted to a certain size of the racket 130. Each of the one or more pegs 111 can be positioned near a different one of the circular openings 118 or the elongated openings 107. In FIG. 2, pegs 111 are removably mounted to the support structure 102 near different circular openings 118. In other embodiments, pegs 111 can be removably mounted to the support structure to correspond to different elongated openings 107. Positioning of a link 114 around a portion of a peg 111 tightens the link 114 to adjust the system 100 to a size of the racket 130 or to tight a link 114 that has increased in length due to wear on the link 114. In some embodiments, the support structure 102 also can include a plurality of peg holes 103 positioned to correspond to a circular opening 118 or an elongated opening 107. The peg holes 103 allow the peg 111 to be positioned at different distances from the head 134 of the racket 130 to allow system 100 to be adjusted to particular sizes of racket heads.

Returning to FIG. 1, the system 100 also includes a plurality of actuators 110 mounted to an actuator mounting surface 105. In some embodiments, at least a portion of the actuators 110 can be mounted to the actuator mounting surface 105 in a selectively movable configuration. For example, in some embodiments, at least a portion of the actuators 110 can be mounted on a track coupled the actuator mounting surface 105. Each actuator 110 mounted on a track can be secured at two more points on the track. This configuration allows the actuator 110 to be mounted to the actuator mounting surface 105 at different linear distances from the head 134 of the racket 130 mounted to the support structure 102, thus allowing for adjustment of the system 100 to meet different size requirements between different rackets. In one or more embodiments, one or more actuators 110 also can be operatively coupled to a controller 125. The controller 125 can be configured to coordinate movement of the actuator 110 on the track. For example, in one or more embodiments, a user can input a racket type or size, and the controller 125 can coordinate movement of the actuator 110 on the track to adjust the system 100 the inputted racket type or size.

The actuator mounting surface 105 can form a plane that is angled relative to a plane formed by the support structure 102. For example, in the system 100, the actuator mounting surface 105 is substantially perpendicular to the support structure 102 and positioned below the support structure 102. Although not shown in FIG. 1, the system 100 also can include one of more removable coverings that cover the actuators 110. In other embodiments, the actuator mounting surface 105 can be form a plane that is substantially parallel to or in the same plane of a plane formed by the support structure 102.

Figure 3A:
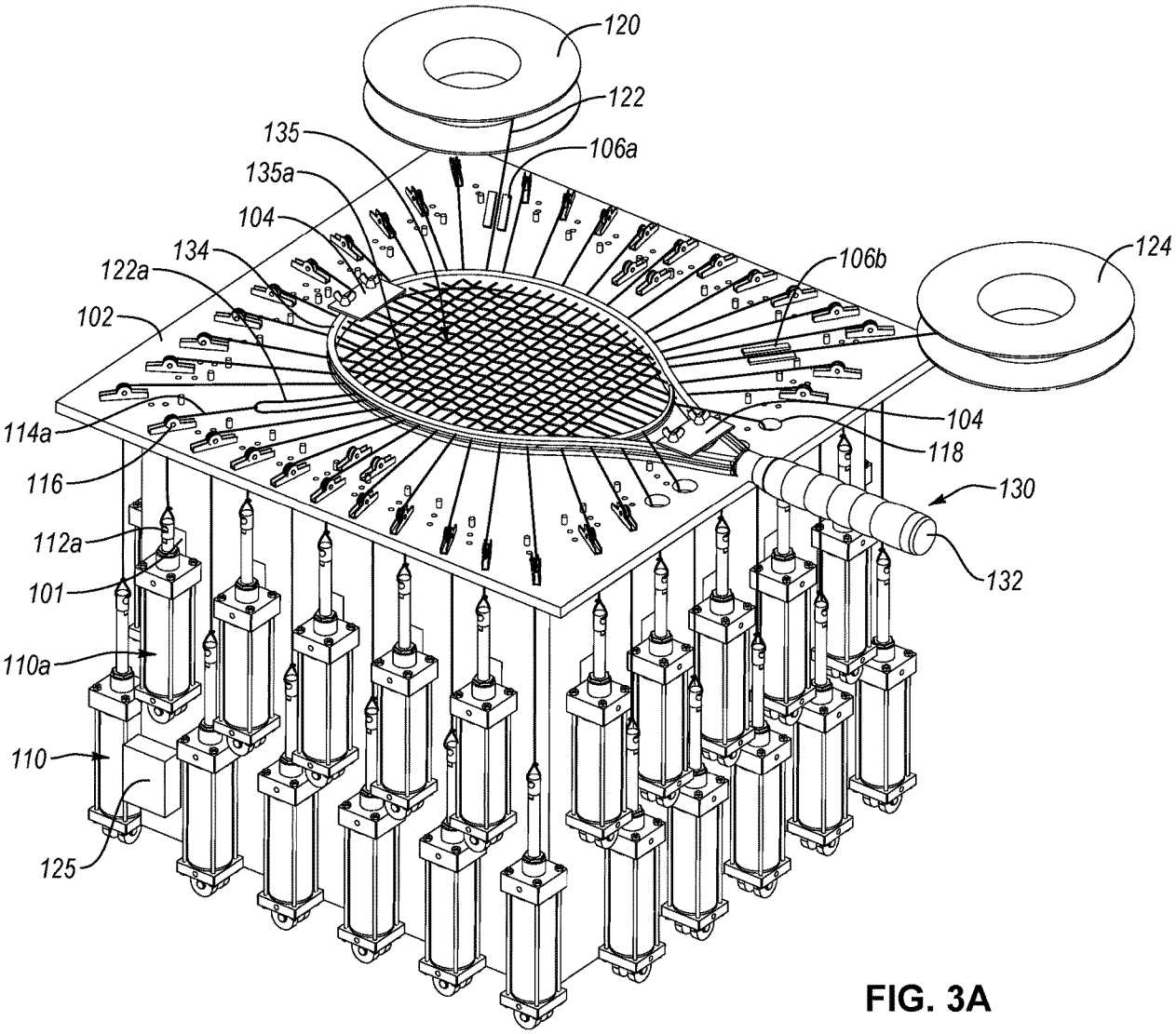
FIGS. 3A and 3B are isometric views of a system for string a racket at different stages of stringing, according to an embodiment.

The plurality of actuators 110 each include selectively movable arm 112 that is movable between a retracted position and an extended position. In FIG. 1, the arms 112 of the plurality of actuators 110 are shown in the extended position. FIG. 3A, which shall be described in greater detail below, includes an actuator 110*a* having an arm 112*a* in a retracted position. In the system 100, the plurality of actuators 110 include a plurality of pneumatic cylinders, and each of the movable arms 112 include a movable piston. In these embodiments, one of a plurality of tubes can couple each actuator 110 to a solenoid configured to force pressurized air to each actuator 110. Accordingly, each actuator 112 also can comprise an air port configured to couple to a tube. The solenoid can coupled to an air compressor configured to provide pressurized air to the solenoid. In other embodiments, the actuator 110 can include other actuators configured to selectively move an arm between a retracted position and an extended position, such as a hydraulic cylinder, mechanical arm, electromagnets, etc.

Each arm 112 can include a link retention structure configured to couple the arm 112 to the link 114. For example, in the system 100, each arm 112 includes a cap threadedly coupled to the arm 112 and configured to couple a link 114 to the arm 112. In other embodiments, the link can include other link retention structures configured to couple the link to the arm, such as a hook, hole, clip, and so on.

The system 100 also includes a plurality of links 114. Each of the plurality of links 114 is configured to couple to a string on the racket at a first portion of the link 114, and also is coupled to a different arm 112 of the plurality of actuators 101 at a second portion of the link 114. FIG. 2 provides a more detailed view of a portion of the plurality of links 114 of the system 100. In many embodiments, each of the plurality of links includes a rope forming a loop. The rope of the link 114 can include a para-aramid synthetic fiber or other suitable material. The rope of the link 114 can loop between the head 134 of the racket 130 and string 122 on the head 134 of the racket 130, the string 122 on the racket 130 being looped between two grommet holes 202 on the racket 130. In other words, the rope of the link 114 can extend (1) between the string 122 and the head 134 of the racket 130 and (2) between two grommet holes 202 through which the string 122 passes to couple the rope to the string 122. This configuration allows the actuator 110 to pull the string 122 away from the head 134 of the racket 130 when the actuator 110 retracts the arm 112 to the retracted position, but also allows the string 122 to slide through looped rope of the link 114 as the string 122 is being tensioned or replaced.

In other embodiments, each of the plurality of links can include other configurations. For example, a link can include a single cord, string or rope coupled to an arm 112 of an actuator 110 at a first end of the link, and coupled to the string 122 of the racket 130 between two grommet holes 202 at a second end of the link. Coupling of the link to the string 122 can include any of a number of different coupling configurations that allow the string 122 to slide through the coupling configuration. For example, the link can be coupled to the string 122 with a ring or hook that allows the link to pull the string away from the head 134 of the racket 130, while also allowing the string 122 to slide through the ring or hook as the string is replaced or tensioned.

When coupled to the arm 112 and the string 122 of the racket 130, the link 114 extends from the arm 112 and passes through one of the elongated openings 107 or the circular openings 118, before angling to the head 134 of the racket 130. If the system 100 includes a pulley block 116 corresponding to the elongated opening 107 or the circular opening 118 through which the link 114 passes, a portion of the link 114 interfaces the wheel 115 of the pulley block 116. The wheel 115 rotates responsive to the link 114 moving as the arm 112 retracts or extends.

The system 100 also can include a string feed assembly 120 configured to provide string 122 to the system 100. As shall be described in greater detail below in relation to FIGS. 3A-3B, the string 122 from the string feed assembly 120 can be woven across the head 134 of the racket 130 to form the face 135 of the racket 130. In the system 100, the string feed assembly 120 includes a spool of racket string. The string feed assembly 120 can be biased or otherwise configured to resist unwinding of string 122 from the string feed assembly 120 in order to keep a desired tension in the string 122 as it is pulled from the string feed assembly 120.

The system 100 also can include a clamp 106*a* positioned between the string feed assembly 120 and the head 134 of the racket 130. The clamp 106*a* is configured to secure a portion of the string 122 within the clamp 106*a* before, during, or after operating of the system 100. When a portion of the string 122 is secured within the clamp 106*a*, the string 122 on the face 135 of the racket 130 can be at least partially tensioned to a predetermined tension. In some embodiments, the clamp 106*a* is positioned on the support structure such that a portion of the head 134 of the racket 130 is positioned between the clamp 106*a* and the string feed assembly 120. In some embodiments, the clamp 106*a* can include any clamp known in the art for restringing a racket. In other embodiments, the clamp 106*a* is not included with system 100. In embodiments that do not employ the clamp 106*a*, the string feed assembly 120 and/or the string collection assembly 124 can tension the string 122 to a desired tension, and conventional handheld clamps can be used to hold the string 122 at the desired tension while the string 122 is tied.

The system 100 also can include a string collection assembly 124 configured to collect string from the racket 130. The string collected from the racket 130 can include racket string 122 or string from a pre-woven template, as shall be described in greater detail below in relation to FIGS. 4 and 5. The string collection assembly 124 can be configured to provide a predetermined force during operation to pull string from the racket 130. For example, the string collection assembly 124 can include a motor assembly configured to rotate a reel in a predetermined direction to pull string from the racket 130. The motor assembly can include a ratchet structure to allow for rotation of the only in a predetermined direction.

The system 100 also can include a clamp 106*b* positioned between the string collection assembly 124 and the head 134 of the racket 130. The clamp 106*b* is configured to secure a portion of the string 122 within the clamp 106*b* during operating of the system 100. When a portion of the string 122 is secured within the clamp 106*b*, the string 122 on the face 135 of the racket 130 can be at least partially tensioned to a predetermined tension. In some embodiments, the clamp 106*b* is positioned on the support structure such that a portion of the head 134 of the racket 130 is positioned between the clamp 106*a* and the string collection assembly 124. In some embodiments, the clamp 106*a* can include any clamp known in the art for restringing a racket. In other embodiments, a clamp 106*b* is not present in the system 100. In embodiments that do not employ the claip 106*b*, the string feed assembly 120 and/or the string collection assembly 124 can tension the string 122 to a desired tension, and conventional handheld clamps can be used to hold the string 122 at the desired tension while the string 122 is tied.

The system 100 also includes a controller 125, which can include a single controller or a plurality of controllers. In an embodiment, the controller 125 includes a relay configured to receive an impulse from a circuit board of the controller 125. The relay can increase the voltage in order to provide the voltage needed for operation of the actuators 110. The controller 125 also is configured to coordinate movement of each arm 112 in the plurality of actuators 110 from the retracted position to the extended position or from the extended position to the retracted position in a predetermined sequence. The controller 125 can include any suitable controller, such as a controller having at least one computing device. The controller 125 having a computing device can be configured to coordinate movement of the arm 112 of each actuator 110, in a predetermined sequence, between an extended position and a retracted position. The computing device of the controller 125 can comprise at least one processor, memory, a storage device, an I/O interface, and a communication interface. In some embodiments, the processor(s) of the controller includes hardware for executing instructions, such as those making up a computer program. The controller 112 also can include programmable software with instructions for coordinating movement of the arm 112 of each actuator 110, in a predetermined sequence, between an extended position and a retracted position. To execute instructions, the processor(s) may retrieve (or fetch) the instructions from an internal register, an internal cache, the memory, or a storage device and decode and execute them.

Movement of each of the plurality of arms 112 in the predetermined sequence is effective to tighten the racket string 122 on the head 134 of the racket 130. As shown in FIG. 2, before each of the plurality of arms 112 are moved in the predetermined sequence, the racket string 122 is woven across the head 134 of the racket 130 such that the face 135 of the racket 130 is formed and different portions of the racket string 122 are positioned between different adjacent grommet holes of the plurality of grommet holes 202 on the head 134 of the racket 130. A portion of each link 114 also is coupled to a different portion of the racket string 122 between two adjacent grommet holes of the plurality of grommet holes 202. In this configuration, the system 100 is ready to tighten the racket string 122 on the head 134 of the racket.

Figure 3B:
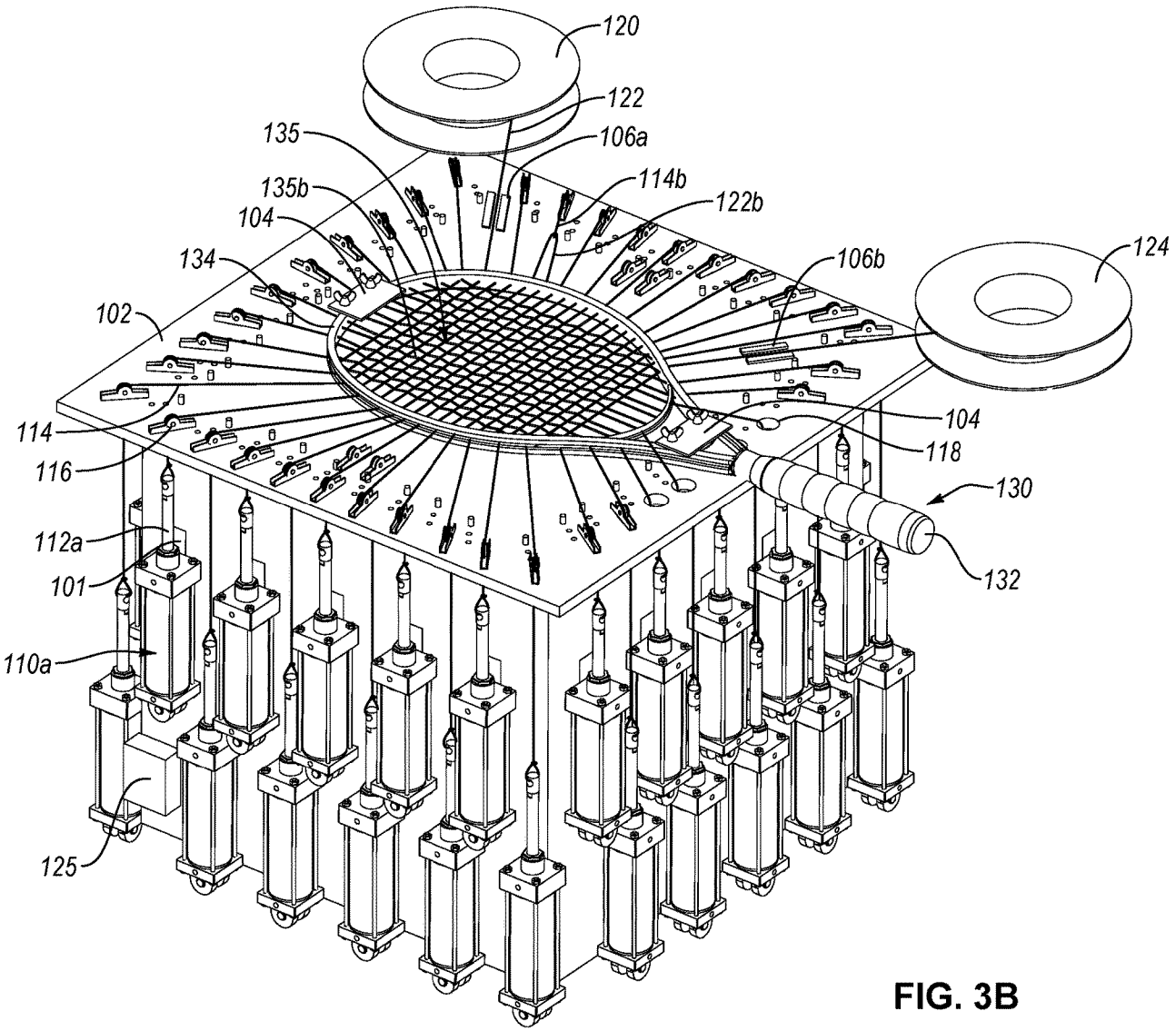

Turning to FIGS. 3A-3B, which illustrate how the system 100 is effective to tighten or tension the racket string 122 on the head 134 of the racket 130 through movement of the each of the plurality of arms 112 in the predetermined sequence, according to an embodiment. In some embodiments, the string feed assembly 120 and/or the string collection assembly 124 are configured to hold the string at desired tension(s) during the restringing process. For example, as the string 122 is tensioned, the sting collection assembly 124 can rotate to collect excess string 122 from the face 135 of the racket 130 that results from an increase in the tension of the string 122.

As shown in FIG. 3A, a first actuator 110*a* retracts a first arm 112*a* to a retracted positioned. A first link 114*a* is coupled to the first arm 112*a* and also a portion 122*a* of the racket string 122. Retraction of the first arm 112*a* pulls the portion 122*a* of the string 122 away from the head 134 of the racket 132 and tightens or tensions the cross string 135*a* that feeds into the top of the portion 122*a* of the racket string 122.

Turning to FIG. 3B, as the first arm 112*a* returns to an extended position, a second actuator (not visible) opposite to the first actuator 110*a* retracts a second arm to a retracted position. A second link 114*b* is coupled to the second arm and also a portion 122*b* of the racket string 122. Retraction of the second arm pulls the portion 122*b* of the string 122 away from the head 134 of the racket 132 and tightens or tensions the cross string 135*b* that feeds into the top of the portion 122*b* of the racket string 122. This sequence of retraction and extension of alternating opposing actuators of the plurality of actuators 110 continues until each cross and each main of the face 135 of the racket 130 is tensioned to a predetermined tension. Multiple iterations of the predetermined sequence can occur, with the each cross string and each main string being increased in tension with each iteration of the predetermined sequence. In many embodiments, the string collection assembly 124 also is configured to pull string from the face 135 of the racket 130 as the racket string 122 is tensioned. Once all the crosses and mains of the face 135 of the racket have been tensioned to the predetermined tension, the clamp 106*b* may secure the second end of the string 122 for tying.

The system 100 also can include a pre-woven string template configured to be coupled to the head 134 of the racket 130 and then used as a guide for stringing the head 134 of the racket 130 with racket string 122. Tensioning of the racket string 122 on the head 134 of the racket 130, as described above, occurs after the pre-woven string template has been removed from the head 134 of the racket 130 and replaced with the racket string 122. While a pre-woven string template can be used in combination with the system 100 in stringing the racket 130, the pre-woven string template is not required in all embodiments of the system 100, as other systems of stringing the racket 130 can be used in combination with the system 100 describe herein.

Figure 4:
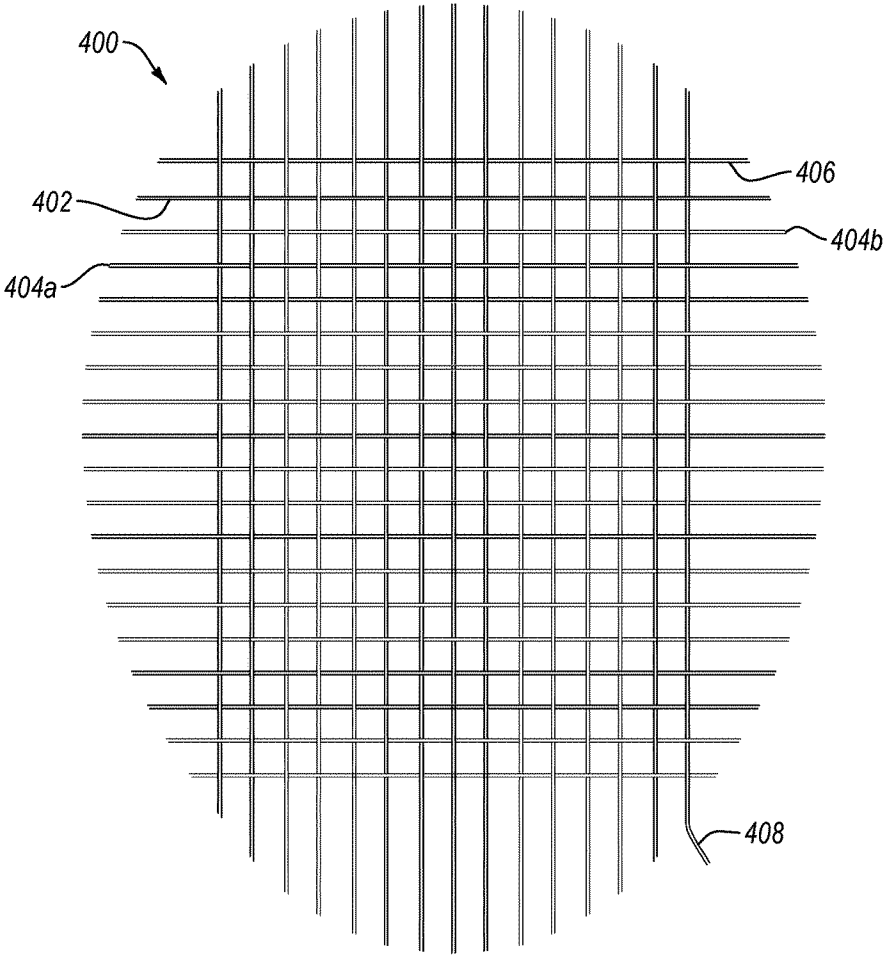
FIG. 4 is top plan view of a string template for stringing a racket, according to an embodiment.

FIG. 4 illustrates a pre-woven string template 400 according to an embodiment. The pre-woven string template 400 can include any of a variety of different strings, such as a braided cord. In many embodiments, the pre-woven string template 400 does not includes conventional racket string. The pre-woven string template 400 includes multiple strings 402 woven in a pattern similar to the face of a racket. For example, in the pre-woven string template 400 shown in FIG. 4, the pre-woven string template 400 includes multiple strings 402 woven together to form 19 cross strings and 15 main strings. Other embodiments can include any number of cross strings and main strings necessary for a certain racket, such as 19 cross strings and 16 main strings. The pre-woven string template can be made either on a loom or with an offsetting two-part grid that creates straight shot openings. In some embodiments, the pre-woven string template 400 includes a braided synthetic cloth string. In other embodiments, the pre-woven string template 400 includes nylon string or other synthetic plastic string varieties.

Figure 5:
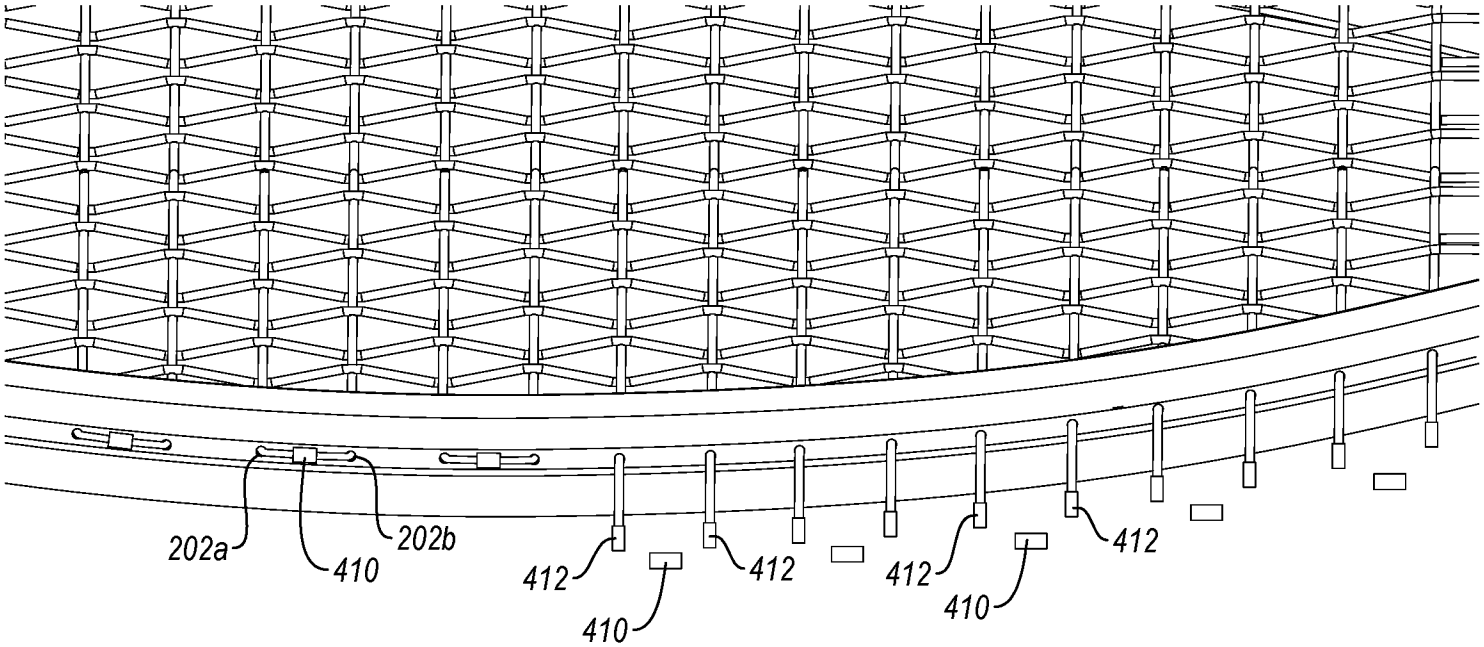
FIG. 5 is an isometric view of a string template partially couple to a head of a racket, according to an embodiment.

Each of the multiple strings 402 includes a first end 404*a* configured to extend through a grommet hole 202*a* (FIG. 5) of the plurality of grommet holes 202 and couple to a first end 404*a* of an adjacent string of the multiple strings extending through an adjacent grommet hole 202*b* (FIG. 5). Each of the multiple strings 402 also includes a second end 404*b* configured to extend through a grommet hole of the plurality of grommet holes 202 and couple to a second end 404*b* of an adjacent string of the multiple strings 402 extending through an adjacent grommet hole. The grommet hole through which the first end 404*a* extends is opposite to the grommet hole through which the second end 404*b* extends on the head 234 of the racket 230.

Turning to FIG. 5, the first ends 404*a* or the second ends 404*b* of adjacent strings of the multiple strings 402 on the string template can be coupled together through any of a number of different coupling systems. For example, in some embodiments, the first ends 404*a* of two adjacent strings of the multiple strings 402 are each coupled to a different hollow-core line 412. The two hollow-core lines 412 can then be coupled to a plastic strip 410 to couple the first ends 404*a* of the two adjacent strings. Coupling of the second ends 404*b* of adjacent strings of the multiple strings 402 can be accomplished in a similar manner. In other embodiments, the first ends 404*a* or second ends 404*b* of adjacent strings of the multiple strings 402 can be coupled together with an adhesive, a knot, or a barbed hook and complementary receiver.

The pre-woven template 400 also includes a first template end 406 configured to couple to a racket string end of the racket string 122 on the string feed assembly 120, and a second template end 408 configured to couple to the string collection assembly 124. In some embodiments, the first template end 406 includes an opening or recess configured to receive an end of the string 122 from the string feed assembly 120. The end of the string 122 in the string feed assembly 120 can include a reduced portion sized to fit at least partially within the opening or recess of the first template end 406. The reduced portion of the string 122 can be shaved or reduced with formic acid to reduce an outer diameter of the end of the string 122. Once the reduced portion of the string 122 is inserted into the first template end 406, the reduced portion of the string 122 and the first template end 406 can be secured with adhesive and/or a sheath covering first template end 406 and the reduced portion of the string 122.

Once the pre-woven template is coupled to the head 134 of the racket 130, replacing the pre-woven template with the racket string 122 can occur through movement of each arm 112 in the plurality of actuators 110 in multiple iterations of the predetermined sequence described above. For example, a first actuator 110*a* retracts a first arm 112*a* to a retracted positioned. A first link 114*a* is coupled to the first arm 112*a* and also a portion of the pre-woven template 400 between adjacent grommet holes 202*a* and 202*b*. Retraction of the first arm 112*a* pulls the portion of the pre-woven template away from the head 134 of the racket 132. This advances the racket string 122 through the head 134 of the racket 130.

As the first arm 112*a* returns to an extended position, a second actuator opposite to the first actuator 110*a* retracts a second arm to a retracted position. A second link 114*b* is coupled to the second arm and also a portion of the pre-woven template 400. Retraction of the second arm pulls the portion of the pre-woven template 400 away from the head 134 of the racket 132 and further advances the racket string 122 through the head of the racket. This sequence of retraction and extension of alternating opposing actuators of the plurality of actuators 110 continues until the racket string 122 has replaced the pre-woven template 400 on the face 135 of the racket 130. Multiple iterations of the predetermined sequence can occur, with the racket string 122 advancing further and further through the face 135 of the racket 130 with each iteration. As the racket string 122 advances through the face 135 of the racket 130 and increasingly replaces the pre-woven template 400, the links 114 will pull a portion of the racket string 122 rather than the pre-woven template 400 when the arms 112 are retracted by the actuators 110. Once all of the pre-woven template 400 has been replaced by the racket string 122 on the face 135 of the racket 130, the racket string 122 can be tensioned, as described above.

In some embodiments, the system 100 also can be used to replace racket string on a stringed racket 130 without a pre-woven template 400. For example, if a user desires to replace the racket string on a stringed racket, and the racket string has not been broken on the racket 130, the user can cut or untie the racket string on the racket 130 at a first end of the racket string, then attach or connect that first end of the racket string from the racket 130 to an end of the string 122 from the string feed assembly. To attach or connect the first end of the racket string from the racket 130 to the end of the string 122 in the string feed assembly 120, the first end of the racket string from the racket 130 can include an opening or recess, and the end of the string 122 in the string feed assembly 120 can include a reduced portion sized to fit at least partially within the opening or recess of the first template end 406. The reduced portion of the string 122 can be shaved or reduced with formic acid to reduce an outer diameter of the end of the string 122. Once the reduced portion of the string 122 is inserted into the first end of the racket string on the racket 130, the reduced portion of the string 122 and the first end of the racket string on the racket can be secured with adhesive and/or a sheath covering first end of the racket string and the reduced portion of the string 122 from the string feed assembly 120.

In other embodiments, the first end of the racket string from the racket 130 can be connected to the end of the string 122 in the string feed assembly 120 with two hollow-core lines 412 and a plastic strip 410, as described above. For example, the first end of the racket string from the racket 130 can be attached to a hollow-core line 412, and the end of the string 122 in the string feed assembly 120 can be attached to a hollow-core line 412. The two hollow-core lines 412 can then be coupled together with a plastic strip 410, without or without an adhesive. In other embodiments, the first end of the racket string on the racket 130 can be connected to the end of the string 122 in the string feed assembly with an adhesive, a knot, or a barbed hook and complementary receiver.

To replace the racket string on the racket 130, a second end of the racket string on the racket 130 also can be cut or untied. The second end of the racket string on the racket 130 can then be attached to the string collection assembly 124. Once the first end of the racket string on the racket 130 is connected to the string 122 in the string feed assembly 120 and the second end of the racket string on the racket 130 is attached to the string collection assembly 124, the system 100 can be activated to pull the string 122 through the head 134 of the racket and replace the pre-existing string on the racket 130, as described above in relation to the racket string 122 replacing the pre-woven template 400 on the head 134 of the racket 130.

Racket string on a stringed racket also is known to occasionally break. Aspects of the system 100 can be used to replace even broken racket string on a stringed racket. For example, if the racket string of a string racket breaks, the two ends of the racket string on the stringed racket can be joined back together, and then the racket string on the stringed racket can be replaced as described above. The two ends of the racket string on the stringed racket can be joined back together by forming an opening or a recess on the first broken end of the racket string from the stringed racket, and then forming a reduced portion on a second broken end of the racket string from the stringed racket, the reduced portion being sized to fit at least partially within the opening or recess of the first broken end. The reduced portion of the second broken end can be shaved or reduced with formic acid to reduce an outer diameter of the second broken end. Once the reduced portion of the second broken end is inserted into the first broken end, the reduced portion of the second broken end and the first broken end can be secured with adhesive and/or a sheath covering first broken end and the second broken end.

In other embodiments, the first broken end of can be connected to the second broken end with two hollow-core lines 412 and a plastic strip 410, as described above. For example, the first broken end can be attached to a hollow-core line 412, and the second broken end 20 can be attached to a hollow-core line 412. The two hollow-core lines 412 can then be coupled together with a plastic strip 410, without or without an adhesive. In other embodiments, the first broken end can be connected to the second broken end with an adhesive, a knot, or a barbed hook and complementary receiver. In some embodiments, a replacement section of string also can be used to connect the first broken end and the second broken end. The replacement section of string can be used to connect the first broken end and the second broken end using hollow-core lines, plastic strips, adhesives, knots, barbed hook and complementary receiver, and/or a recess and reduced portion, as described above.

Figure 7:
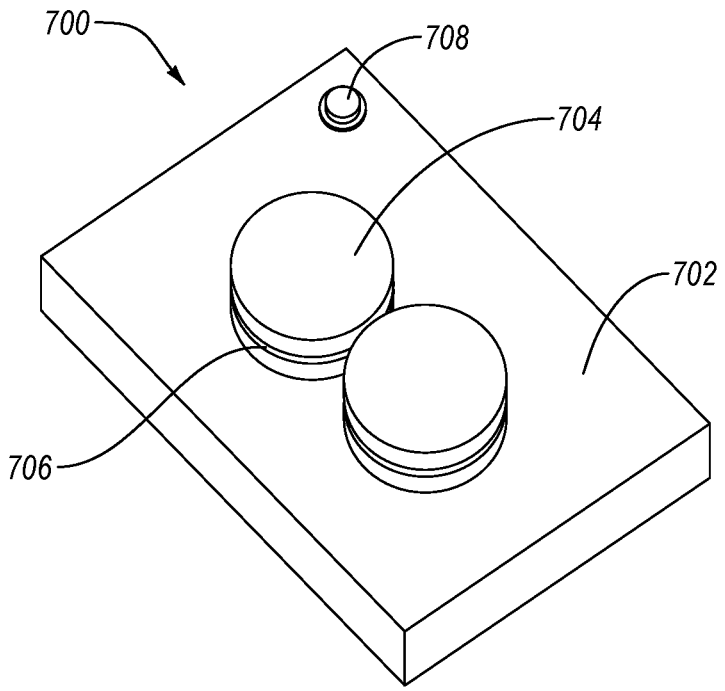
FIG. 7 is an isometric view of a template feed assembly, according to an embodiment.

Turning to FIG. 7, in some embodiments, system 100 can include a template feed assembly 700. The template feed assembly 700 can be used to assist in creating either the pre-woven template 400 and/or inserting strings on the head 134 of the racket 130. The template feed assembly can include a motor housed within a housing 702 and two wheels 704 mounted on an exterior of the housing. The two wheels 704 can each include a groove 706 on an outer periphery of the wheel 704. The wheels 704 are positioned with the outer peripheries proximate or even adjacent to one another, with the grooves 706 on the outer peripheries aligned with one another. When the grooves 706 are aligned, the template string 402 and/or the racket string fit within the aligned grooves and interface the grooves. In response to activation of the motor by a user pressing an activation button 708, the two wheels 704 can rotate to feed the template string 402 and/or the racket string through the template feed assembly 700. In some embodiments, the wheels 704 of the template feed assembly 700 also can include latch or hook configured to couple to the string and pull the string.

In some embodiments, one or more template feed assemblies 700 can be secured to or otherwise positioned on the support structure 102 of the system 100. The one or more template feed assemblies 700 can feed string through one or more grommets in the head 134 and across the head 134. In some embodiments, system 100 can include two template feed assemblies 700. The two template feed assemblies 700 can be positioned on opposing sides of the head 134 of the racket 130. The two template feed assemblies 700 can be moved from one grommet to an adjacent grommet on the head 134, feeding string across the head 134 to create the face 135 of the racket 300 with a plurality of cross strings and/or main strings.

Figure 6:
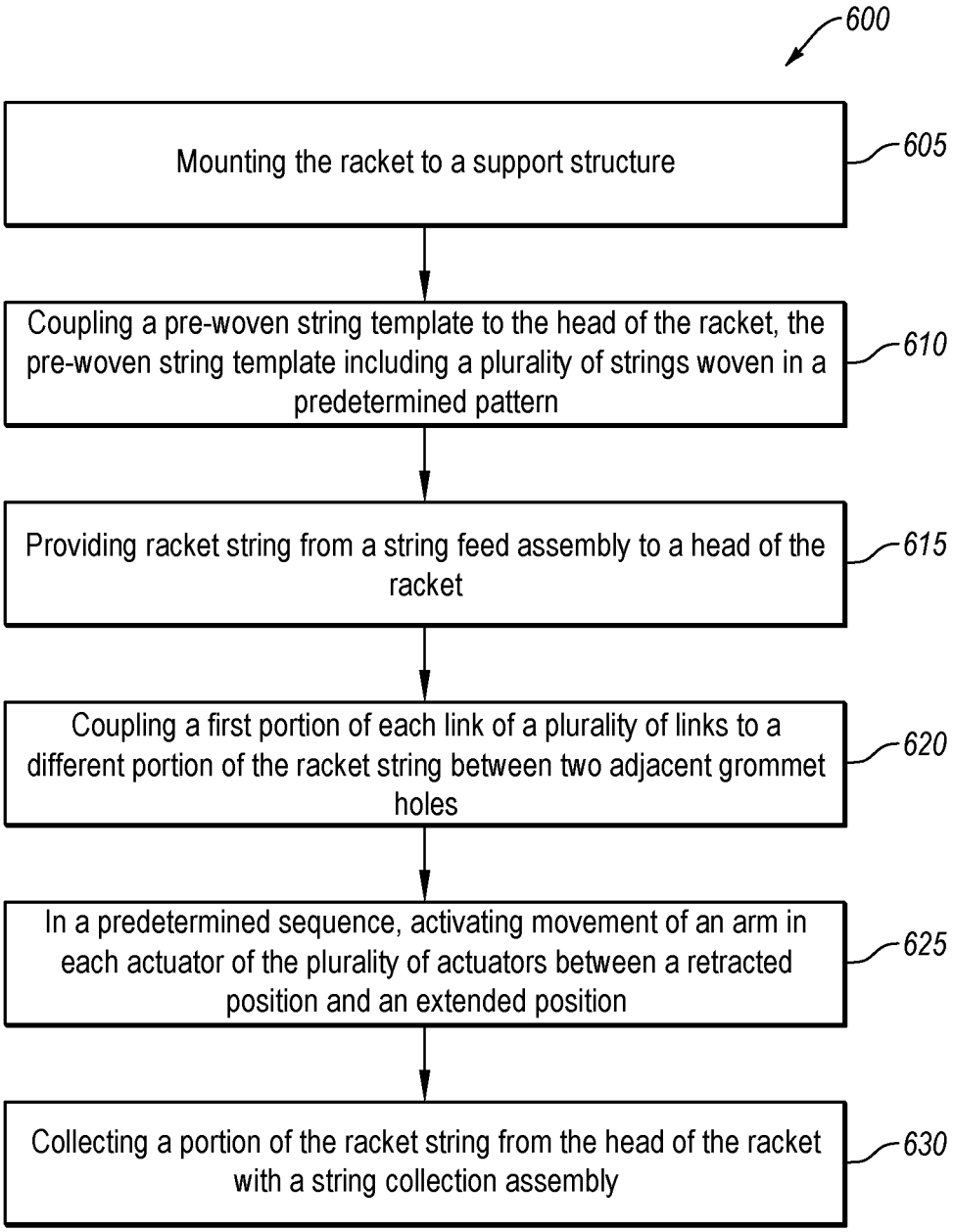
FIG. 6 is a flowchart of a method of stringing a racket, according to an embodiment.

Also contemplated as part of this disclosure are one or more methods of stringing a racket. FIG. 6 is an example flowchart of a method 600 of stringing a racket. An example method may include one or more operations, functions, or actions as illustrated by one or more blocks of 605, 610, 615, 620, 625, and/or 630.

The method allows a user to string a racket, such as a tennis, racquetball, or badminton racket. An example method may begin with block 605, which recites "mounting the racket to a support structure." Block 605 may be followed by block 610, which recites "coupling a pre-woven string template to the head of the racket, the pre-woven string template including a plurality of strings woven in a predetermined pattern." Block 610 may be followed by block 615, which recites "providing racket string from a string feed assembly to a head of the racket." Block 615 may be followed by block 620, which recites "coupling a first portion of each link of a plurality of links to a different portion of the racket string between two adjacent grommet holes." Block 620 may be followed by block 625, which recites "in a predetermined sequence, activating movement of an arm in each actuator of the plurality of actuators between a retracted position and an extended position. Block 625 may be followed by block 630, which recites "collecting a portion of the racket string from the head of the racket with a string collection assembly."

The blocks included in the described example methods are for illustration purposes. In some embodiments, the blocks may be performed in a different order. In some other embodiments, various blocks may be eliminated. In still other embodiments, various blocks may be divided into additional blocks, supplemented with other blocks, or combined together into fewer blocks. Other variations of these specific blocks are contemplated, including changes in the order of the blocks, changes in the content of the blocks being split or combined into other blocks, etc.

Block 605 recites "mounting the racket to a support structure." One or more mounting devices on the support structure can be used in the act of mounting the racket to the support structure. Mounting the racket to the support structure also can include moving one or more of a plurality of pulleys on the support structure to adjust to a size of the racket. Mounting the racket to the support structure also can include moving one or more pegs on the support structure to adjust to a size of the racket. The plurality of pulleys and the one or more pegs are configured and positioned to interface with one or more links extending between an actuator and the string on the racket, described in greater detail below.

Block 610 recites "coupling a pre-woven string template to the head of the racket, the pre-woven string template including a plurality of strings woven in a predetermined pattern." Coupling the pre-woven string template to the head of the racket can include, for each string of multiple strings of the plurality of strings, inserting a first end of the string through a first grommet hole of the plurality of grommet holes, and inserting a second end of the string through a second grommet hole of the plurality of grommet holes distal to the first grommet hole.

Coupling the pre-woven string template to the head of the racket also can include, for each string of multiple strings of the plurality of strings, coupling the first end to the first end of a first adjacent string of the multiple strings extending through a first adjacent grommet hole of the plurality of grommet holes, and coupling the second end to the second end of a second adjacent string of the multiple strings extending through a second adjacent grommet hole of the plurality of grommet holes. Coupling the ends to the adjacent strings of the multiple strings extending through adjacent grommet holes can include coupling the end of the string to a hollow-core line, and then coupling a plastic strip to hollow-core lines of adjacent strings.

Coupling the pre-woven string template to the head of the racket can include coupling a first template end to a racket string end of the racket string on the string feed assembly and coupling a second template end to the string collection assembly. In some embodiments of the method 600, the racket may already include racket string that will be tensioned woven on the face of the racket, and thus the acts of block 610 may be skipped. When replacing racket string already included on the racket, a first end of the racket string on the racket can be configured to include an opening or recess configured to receive an end of the string from the string feed assembly. The end of the string in the string feed assembly can include a reduced portion sized to fit at least partially within the opening or recess of the first end of the racket string. The reduced portion of the string can be shaved or reduced with formic acid to reduce an outer diameter of the end of the string. Once the reduced portion of the string is inserted into the first end of the racket string already on the racket, the reduced portion of the string and the first end of the racket string already on the racket can be secured with adhesive and/or a sheath covering first end of the racket string already on the racket and the reduced portion of the string from the string feed assembly.

Block 615 recites "providing racket string from a string feed assembly to a head of the racket." In some embodiments, providing the racket string from a string feed assembly to the head of the racket can include, with a controller and in a predetermined sequence, activating movement of an arm in each actuator of a plurality of actuators between the retracted position and the extended position to pull the racket string through the plurality of grommet holes, weave the racket string on the head of the racket, and collect the pre-woven string template on the string collection assembly from the head of the racket. As the racket string is pulled through the plurality of grommet holes and the string from the pre-woven string template is collected on the string collection assembly, the racket string replaces the string of the pre-woven string template on the face of the racket.

Activating movement of the arm in each actuator in the predetermined sequence can include, for example, retracting the arm of a first actuator to a retracted positioned. A first link is coupled to the arm of the first actuator and also a portion of the pre-woven template between adjacent grommet holes. Retraction of the arm of the first actuator pulls the portion of the pre-woven template away from the head of the racket. This advances the racket string through the head of the racket. As the arm of the first actuator returns to an extended position, a second actuator opposite to the first actuator retracts an arm to a retracted position. A second link is coupled to the arm of the second actuator and also a portion of the pre-woven template. Retraction of the arm of the second actuator pulls the portion of the pre-woven template away from the head of the racket and further advances the racket string through the head of the racket. This sequence of retraction and extension of alternating opposing actuators of the plurality of actuators continues until the racket string has replaced the pre-woven template on the face of the racket. Multiple iterations of the predetermined sequence can occur, with the racket string advancing further and further through the face of the racket with each iteration. As the racket string advances through the face of the racket and increasingly replaces the pre-woven template, the links will pull a portion of the racket string rather than the pre-woven template when the arms are retracted by the actuators.

In some embodiments, the plurality of links can each include a rope. The act(s) of block 615 also can include interfacing, between the arm and the racket, the rope of at least a portion of the plurality of links with a different one of a plurality of pulleys coupled to the support structure. The act(s) of block 615 also can include interfacing, between the arm and the racket, the rope of at least a portion of the plurality of links with a different one of one or more pegs coupled to the support structure.

In some embodiments, the act(s) of block 615 can occur without a pre-woven string template being pulled through the racket and replaced by racket string. For example, the act(s) of block 615 can include providing racket string from a string feed assembly to a head of the racket such that different portions of the racket string are positioned between different adjacent grommet holes of a plurality of grommet holes on the head of the racket. The racket string can, in some embodiments, be woven on the face of the racket manually or as in conventionally done in the art of stringing a racket. In some embodiments, block 615 also can include clamping a first end of the racket string with a first clamp positioned between the string feed assembly and a first grommet hole of the plurality of grommet holes before or after the racket string has been tightened on the head of racket.

Block 620 recites "coupling a first portion of each link of a plurality of links to a different portion of the racket string between two adjacent grommet holes." More particularly, the act of block 620 can include coupling a first portion of each link of a plurality of links to a different portion of the racket string between two adjacent grommet holes of the plurality of grommet holes on the head of the racket. A second portion of each link of the plurality of links is coupled to a different actuator of a plurality of actuators. In embodiments of the method 400 utilizing a pre-woven string template, the act(s) of block 620 can occur automatically as the racket string is pulled through the head of the racket to replace the pre-woven string template.

In some embodiments, the plurality of links can each include a rope. The act(s) of block 620 also can include interfacing, between the arm and the racket, the rope of at least a portion of the plurality of links with a different one of a plurality of pulleys coupled to the support structure. The act(s) of block 620 also can include interfacing, between the arm and the racket, the rope of at least a portion of the plurality of links with a different one of one or more pegs coupled to the support structure.

Block 625 recites "in a predetermined sequence, activating movement of an arm in each actuator of the plurality of actuators between a retracted position and an extended position." A controller operatively coupled to the plurality of actuators can coordinate movement of the arms of the plurality of actuators. When an arm of an actuator is moved from the extended position to the retracted position, the link coupled to the arm pulls the portion of the racket string positioned between the adjacent grommet holes away from the adjacent grommet holes to tighten a portion of the racket string on the head of racket.

More particularly, the acts of block 625 can include activating retraction of an arm of a first actuator to a retracted positioned. A first link is coupled to the arm of the first actuator and also a portion of the racket string. Retraction of the first arm pulls the portion of the racket string away from the head of the racket and tightens or tensions the cross string or the main string that feeds into a first grommet hole of the adjacent grommet holes. The acts of block 625 also can include activating return of the arm of the first actuator to an extended position and substantially simultaneously activating retraction of an arm of a second actuator opposite to the first actuator. A second link is coupled to the arm of the second actuator and also a portion of the racket string. Retraction of the arm of the second actuator pulls the portion of the string away from the head of the racket and tightens or tensions the cross string or the main string that feeds into a first grommet hole of the adjacent grommet holes. This sequence of retraction and extension of alternating opposing actuators of the plurality of actuators continues until each cross and each main of the face of the racket is tensioned to a predetermined tension. Multiple iterations of the predetermined sequence can occur, with the each cross string and each main string being increased in tension with each iteration of the predetermined sequence.

Block 630 recites "collecting a portion of the racket string from the head of the racket with a string collection assembly." In many embodiments, the acts of block 630 also can include pulling, with the string collection assembly, string from the face of the racket as the racket string is tensioned. The acts of block 630 also can include, once all the crosses and mains of the face of the racket have been tensioned to the predetermined tension, securing the racket within a clamp between the string collection assembly and the racket and/or tying the racket string.

Although the systems and methods described above have been discussed in the context of stringing and tensioning a racket, in other embodiments, the systems and methods disclosed herein are not limited to such use and may be used for many different applications, if desired, without limitation. Thus, such systems, methods, and apparatuses are not limited for use with stringing and tensioning system, and may be used with various mechanical systems, without limitation.

While various aspects and embodiments have been disclosed herein, other aspects and embodiments are contemplated. The various aspects and embodiments disclosed herein are for purposes of illustration and are not intended to be limiting.

What is claimed is:

1. A system for stringing a racket, the system comprising:
- a support structure;
- one or more mounting devices configured to mount the racket to the support structure;
- a plurality of actuators, each actuator of the plurality of actuators including a selectively movable arm movable between a retracted position and an extended position;
- a plurality of links, each link of the plurality of links being configured to couple to a string on the racket at a first portion of the link and coupled to a different arm of the plurality of actuators at a second portion of the link;
- a string feed assembly configured to provide racket string to the racket for stringing;
- a string collection assembly configured to collect string from the racket; and
- a controller configured to coordinate movement of each arm in the plurality of actuators from the retracted position to the extended position or from the extended position to the retracted position in a predetermined sequence,
- wherein movement of each arm of the plurality of actuators in the predetermined sequence is effective to tighten the racket string on the head of racket when:
  - the racket string from the string feed assembly is woven across a head of the racket such that different portions of the racket string are positioned between different adjacent grommet holes of a plurality of grommet holes on the head of the racket; and
  - the first portion of each link of the plurality of links is coupled to a different portion of the racket string between two adjacent grommet holes of the plurality of grommet holes on the head of the racket such that when the arm moves from the extended position to the retracted position, the link pulls the portion of the racket string positioned between the adjacent grommet holes away from the adjacent grommet holes.

2. The system of claim 1, further comprising a pre-woven string template including a plurality of strings woven in a predetermined pattern, the plurality of strings including:
- multiple strings each of which includes:
  - a first end configured to extend through a first grommet hole of the plurality of grommet holes and couple to a first end of a first adjacent string of the multiple strings extending through a first adjacent grommet hole of the plurality of grommet holes; and
  - a second end configured to extend through a second grommet hole of the plurality of grommet holes and couple to a second end of a second adjacent string of the multiple strings extending through a second adjacent grommet hole of the plurality of grommet holes;

a first template end configured to couple to a racket string end of the racket string on the string feed assembly; and a second template end configured to couple to the string collection assembly, wherein movement of each arm in the plurality of actuators in the predetermined sequence pulls the racket string through the plurality of grommet holes and weaves the racket string on the head of the racket when:

the pre-woven string template is coupled to the head of the racket with the first end of each of the multiple strings coupled to the first end of the first adjacent string, the second end of each of the multiple strings is coupled to the second end of the second adjacent string, the first template end is coupled to the racket string end of the racket string on the string feed assembly, and the second template end is coupled to the string collection assembly.

3. The system of claim 2, wherein:

the first end of each of the multiple strings is coupled to the first end of the first adjacent string with two first hollow-core lines each coupled to one of the first end of the string and the first end of the first adjacent string, and a plastic strip coupled to the two first hollow-core lines between the two first hollow-core lines; and the second end of each of the multiple strings is coupled to the second end of the second adjacent string with two second hollow-core lines each coupled to one of the second end of the string and the second end of the second adjacent string, and a second plastic strip coupled to the two second hollow-core lines between the two second hollow-core lines.

4. The system of claim 2, further comprising one or more pegs removably coupled to the support structure, wherein each of the plurality of links includes a looped rope of para-aramid synthetic fiber and positioning a link of the plurality of links around a portion of a peg of the one or more pegs tightens the link to adjust to a size of the racket.

5. The system of claim 1, wherein each of the plurality of links includes a rope extending between the string and the head of the racket and between two grommet holes of the plurality of grommet holes through which the string passes to couple the rope to the string.

6. The system of claim 5, further comprising a plurality of pulleys coupled to the support structure, wherein the rope of at least a portion of the plurality of links interfaces a different one of the plurality of pulleys between the second portion of the link and the first portion of the link.

7. The system of claim 6, wherein one or more of the plurality of pulleys are movably mounted to the support structure to adjust to a size of the racket.

8. The system of claim 1, further comprising:

a first clamp positioned between the string feed assembly and a first grommet hole of the plurality of grommet holes, the first clamp configured to clamp a first end of the racket string before the racket string has been tightened on the head of racket; and a second clamp positioned between the string collection assembly and a second grommet hole of the plurality of grommet holes, the second clamp configured to clamp a second end of the racket string after the racket string has been tightened on the head of the racket.

9. A pre-woven string template for restringing a racket, the template comprising:

a plurality of strings woven in a predetermined pattern of a stringed face of the racket, multiple strings of the plurality of strings each having:

a first end configured to extend through a first grommet hole of a plurality of grommet holes on a head of the racket and couple to a first end of a first adjacent string of the multiple strings extending through a first adjacent grommet hole of the plurality of grommet holes; and a second end configured to extend through a second grommet hole of the plurality of grommet holes and couple to a second end of a second adjacent string of the multiple strings extending through a second adjacent grommet hole of the plurality of grommet holes;

a first template end on one of the plurality of strings configured to couple to a racket string end of a racket string on a string feed assembly of a restringing system; and a second template end on one of the plurality of strings configured to couple to a string collection assembly of the restringing system.

10. The template of claim 9, further comprising a plurality of hollow-core lines, each hollow-core line of the plurality of hollow-core lines coupled to a different first end or a different second end of the multiple strings.

11. The template of claim 9, further comprising a plurality of plastic strips, each plastic strip of the plurality of plastic strips configured to couple to hollow-core lines of adjacent strings of the multiple strings.

12. A method of stringing a racket, the method comprising:

mounting the racket to a support structure;

providing racket string from a string feed assembly to a head of the racket such that different portions of the racket string are positioned between different adjacent grommet holes of a plurality of grommet holes on the head of the racket;

coupling a first portion of each link of a plurality of links to a different portion of the racket string between two adjacent grommet holes of the plurality of grommet holes on the head of the racket, a second portion of each link of the plurality of links being coupled to a different actuator of a plurality of actuators with a controller and in a predetermined sequence, activating movement of an arm in each actuator of the plurality of actuators between a retracted position and an extended position such that when the arm moves from the extended position to the retracted position, the link pulls the portion of the racket string positioned between the adjacent grommet holes away from the adjacent grommet holes to tighten the racket string on the head of racket; and collecting a portion of the racket string from the head of the racket with a string collection assembly.

13. The method of claim 12, further comprising:

coupling a pre-woven string template to the head of the racket, the pre-woven string template including a plurality of strings woven in a predetermined pattern, wherein coupling the pre-woven string template to the head of the racket includes:

for each string of multiple strings of the plurality of strings:

inserting a first end of the string through a first grommet hole of the plurality of grommet holes;

inserting a second end of the string through a second grommet hole of the plurality of grommet holes distal to the first grommet hole;

coupling the first end to the first end of a first adjacent string of the multiple strings extending through a first adjacent grommet hole of the plurality of grommet holes; and coupling the second end to the second end of a second adjacent string of the multiple strings extending through a second adjacent grommet hole of the plurality of grommet holes;

coupling a first template end to a racket string end of the racket string on the string feed assembly;

coupling a second template end to the string collection assembly; and with the controller and in the predetermined sequence, activating movement of the arm in each actuator of the plurality of actuators between the retracted position and the extended position to:

pull the racket string through the plurality of grommet holes;

weave the racket string on the head of the racket; and collect the pre-woven string template on the string collection assembly from the head of the racket.

14. The method of claim 13, wherein:

for each string of the multiple strings, coupling the first end to the first end of a first adjacent string of the multiple strings extending through a first adjacent grommet hole of the plurality of grommet holes includes:

for each string of the multiple strings, coupling the first end to a first hollow-core line; and coupling a plastic strip to first hollow-core lines of adjacent strings of the multiple strings; and for each string of the multiple strings, coupling the second end to the second end of a second adjacent string of the multiple strings extending through a second adjacent grommet hole of the plurality of grommet holes includes:

for each string of the multiple strings, coupling the second end to a second hollow-core line; and coupling a plastic strip to second hollow-core lines of adjacent strings of the multiple strings.

15. The method of claim 12, wherein each of the plurality of links includes a rope extending between the string and the head of the racket and between two grommet holes of the plurality of grommet holes through which the string passes to couple the rope to the string.

16. The method of claim 15, further comprising interfacing, between the first portion of the link and the second portion of the link, the rope of at least a portion of the plurality of links with a different one of a plurality of pulleys coupled to the support structure.

17. The method of claim 16, further comprising moving one or more of the plurality of pulleys on the support structure to adjust to a size of the racket.

18. The method of claim 15, further comprising positioning a link of the plurality of links around a portion of a peg of one or more pegs removably coupled to the support structure to tighten the link and adjust to a size of the racket.

19. The method of claim 12, further comprising:

clamping a first end of the racket string with a first clamp positioned between the string feed assembly and a first grommet hole of the plurality of grommet holes before the racket string has been tightened on the head of racket; and clamping a second end of the racket string with a second clamp positioned between the string collection assembly and a second grommet hole of the plurality of grommet holes after the racket string has been tightened on the head of the racket.

* * * * *